US005822665A

United States Patent [19]

Yamamoto et al.

[11] Patent Number: 5,822,665

[45] Date of Patent: Oct. 13, 1998

[54] IMAGE FORMING APPARATUS HAVING MEANS FOR PREVENTING VIBRATION OF A TRANSFER FILM CAUSED FROM THE OPERATION OF A SEPARATING DEVICE

[75] Inventors: Keiji Yamamoto; Nobuyoshi Komatsu; Yoshihiro Enomoto; Masaaki Tokunaga; Satoshi Fukada; Tetsuya Fujita; Fumio Furusawa; Nobuo Hyakutake, all of Ebina, Japan

[73] Assignee: Fuji Xerox Co., Ltd., Tokyo, Japan

[21] Appl. No.: 856,189

[22] Filed: May 14, 1997

[30] Foreign Application Priority Data

May 16, 1996 [JP] Japan ..... 8-121827
Aug. 15, 1996 [JP] Japan ..... 8-215717

[51] Int. Cl.[6] ..... G03G 15/14; G03G 15/01

[52] U.S. Cl. ..... 399/303; 399/315

[58] Field of Search ..... 399/303, 304, 399/313, 315, 319, 317

[56] References Cited

U.S. PATENT DOCUMENTS 5,086,318 2/1992 Takeda et al. ..... 399/303
5,666,621 9/1997 Maekawa et al. ..... 399/303

FOREIGN PATENT DOCUMENTS 6-051652 2/1994 Japan .

*Primary Examiner*—Arthur T. Grimley
*Assistant Examiner*—Sophia S. Chen
*Attorney, Agent, or Firm*—Oliff & Berridge, PLC

[57] ABSTRACT

An object of the present invention is to provide an image forming apparatus capable of preventing vibration of a transfer film caused from the operation of a separating device to prevent irregular density distribution and change in the hue. The image forming apparatus according to the present invention and having: a transfer-medium holding member having a transfer film for adsorbing and carrying a transfer medium and arranged such that an image is formed on the transfer medium; an internally and upwardly pushing member movably disposed on the surface of the transfer film opposite to the surface to which the transfer medium is adsorbed; a moving device for moving the internally and upwardly pushing member by a predetermined quantity so that the internally and upwardly pushing member upwardly pushes the transfer film to deform the transfer film to separate the transfer medium from the transfer film; and a preventing device for preventing vibration of the internally and upwardly pushing member.

11 Claims, 12 Drawing Sheets

IMAGE FORMING APPARATUS HAVING MEANS FOR PREVENTING VIBRATION OF A TRANSFER FILM CAUSED FROM THE OPERATION OF A SEPARATING DEVICE

BACKGROUND OF THE INVENTION

1. Field of the Invention

The present invention relates to an image forming apparatus for use in a copying machine, a printer or the like, and more particularly to an image forming apparatus for forming an image on a transfer medium, such as paper, held by a transfer-medium holder.

2. Description of the Related Art

Hitherto, the image forming apparatus has one photosensitive drum, a monochrome-toner-image forming portion having black toner, yellow toner, magenta toner and cyan toner to sequentially form respective color toner images on the photosensitive drum and an image forming portion having a transfer drum disposed opposite to the photosensitive drum and arranged to adsorb and hold the transfer medium to sequentially transfer monochrome toner images formed on the photosensitive drum to the surface of the transfer medium so as to form an image on the transfer medium.

The monochrome-toner-image forming portion has the photosensitive drum disposed rotatively, a charging corotron for charging the photosensitive drum to have a uniform potential, an exposing device for exposing the photosensitive drum in accordance with information of color images and a developing unit for accommodating four color toners and supplying the color toners to the photosensitive drum. The charging corotron and the exposing device form a latent image on the photosensitive drum while rotating the photosensitive drum. Then, the developing unit develops the latent image. Thus, the monochrome-toner-image forming portion forms monochrome toner images in the respective colors on the photosensitive drum.

The image forming portion has a rotative transfer drum disposed opposite to the photosensitive drum, a transfer corotron disposed opposite to the photosensitive drum through the transfer drum and structured to form a transfer-ring electric field in a space formed between the photosensitive drum and the transfer corotron, a transfer medium accommodating tray for accommodating a multiplicity of transfer mediums, a transfer-medium supply and moving member for moving the transfer medium from the transfer medium accommodating tray to the transfer drum, an adsorbing charger for electrostatically adsorbing the transfer medium to the transfer drum, a separation device for separating the transfer medium from the transfer drum, a fixing unit for fixing a multi-color toner image to the transfer medium and a transfer medium discharge tray to which the transfer medium is discharged. Initially, the image forming portion supplies the transfer medium from the transfer medium accommodating tray to the transfer drum to cause the transfer medium to be adsorbed by the transfer drum so as to transfer the monochrome toner image on the transfer medium. Then, the transfer medium is separated from the transfer drum to discharge the transfer medium to the transfer medium discharge tray through the fixing unit. Thus, the image forming portion forms an image on the transfer medium. Note also image forming apparatuses of a type having no transfer-medium supply and moving member, the adsorbing charger and the separation device are general type apparatuses.

When a multi-color image or a full color image is formed on a transfer medium by the above-mentioned image forming apparatus, respective monochrome toner images are sequentially formed on the photosensitive drum. Then, the monochrome toner images are stacked and transferred to the surface of the transfer medium so that a multi-color toner image is formed on the transfer medium. Then, the transfer medium is supplied to the fixing unit, and then discharged to the transfer medium discharge tray.

The transfer drum of the above-mentioned image forming apparatus generally has a structure consisting of a fixed transfer drum shaft, a pair of transfer rings disposed rotatively around the shaft, a ring tie plate for fixing the two transfer rings to each other and a transfer film formed into a tubular shape and disposed between the two transfer rings. The general type transfer drum is structured to adsorb the transfer medium to the surface of the transfer film to hold the transfer medium.

A portion of the separation device of the image forming apparatuses has a destaticizing corotron disposed on the outside of the transfer film to destaticize the transfer film and the transfer medium, a separation claw movably disposed downstream from the transfer drum in the rotating direction to press the transfer film from outside when the transfer medium is separated, and an internally and upwardly pushing member disposed upstream from the transfer drum in the rotating direction to press the transfer film from an inside portion when the transfer medium is separated. Thus, the destaticizing corotron reduces the electrostatic adsorbing force which acts on the transfer film. Moreover, the internally and upwardly pushing member deforms the transfer film to form a gap between the transfer film and the transfer medium. In addition, the separation claw is inserted between the transfer film and the transfer medium so that the transfer medium is reliably separated from the transfer drum.

FIG. 16 is a schematic cross sectional view of an example of a color image forming apparatus having a multiple transfer apparatus comprising a transfer drum.

The color image forming apparatus shown in FIG. 16 has a photosensitive drum 101 which is charged by a charging unit 102, and then exposed to light by an exposing unit 103. Thus, a black latent image is formed at a predetermined position on the photosensitive drum 101. Then, a black developing part 104K of a developing unit 104 develops the latent image.

A paper sheet is moved along a paper chute 119, and then electrostatically adsorbed to the surface of a transfer film 109*a* of a transfer drum 109 by an adsorbing corotron 111 or a transfer corotron 112 which is operated in a case where the adsorbing corotron 111 is omitted from the structure. A toner image on the photosensitive drum 101 is, by the transfer corotron 112, transferred to the paper sheet adsorbed by the transfer film 109*a*. The transfer corotron 112 is disposed in the inside portion of the transfer drum 109 at a position opposite to the photosensitive drum 101 so as to apply a charge having polarity (which is plus in the case shown in FIG. 16) opposite to the polarity (which is minus in the case shown in FIG. 16) of the charge of the toner from a back of the paper sheet. Thus, the toner on the photosensitive drum 101 is electrostatically transferred to the surface of the paper sheet P. Toner left on the photosensitive drum 101 is removed by a cleaning unit 107.

Similarly, yellow, magenta and cyan toner images are sequentially formed on the surface of the photosensitive drum 101 in synchronization with the rotation of the transfer drum 109. Moreover, the paper is rotated in a state where it is electrostatically adsorbed to the surface of the transfer film of the transfer drum 109. Whenever the transfer drum

109 is rotated, the toner image in each color is transferred from the photosensitive drum 101 to the position of the paper so that a multi-color image is formed on the paper. The paper P, on which the multi-color image has been formed, is separated from the surface of the transfer film 109*a* of the transfer drum 109 by a separating section 150, and then subjected to a fixing process.

The separating section 150 has an internally and upwardly pushing member 151 and a separation claw 11*b*. The internally and upwardly pushing member 151 upwards pushes a portion of the transfer film 109*a* of the transfer drum 109 from the inside portion of the same so as to upwards loose the leading end of the paper P from the transfer film 109*a*. Then, the leading end of the separation claw 11*b* is inserted into the leading end of the paper P which has been moved upwards. Thus, the foregoing separation operation is performed so that the paper P electrically adsorbed to the transfer film 109*a* is mechanically separated.

However, in the above-mentioned image forming apparatus, the internally and upwardly pushing member and the transfer film are vibrated when the internally and upwardly pushing member is brought into contact with the transfer drum. If transference of a toner image to the transfer medium is being performed when the internally and upwardly pushing member is brought into contact with the transfer drum, the vibrations of the transfer film cause a defect in transference to take place. As a result, irregular density distribution and change in the hue take place.

If a swinging device for swinging the internally and upwardly pushing member has internal frames disposed between the pair of the transfer rings such that the internal frames are secured to the transfer drum shaft and having a cut hole, a holding member for holding the internally and upwardly pushing member movably disposed in the cut hole and structured to hold the internally and upwardly pushing member and an electromagnetic solenoid for swinging the holding member to bring the holding member into contact with the surface of the cut hole, the holding member is vibrated immediately after the holding member is brought into contact with the surface of the cut hole. As a result, the internally and upwardly pushing member and the transfer film are vibrated. Thus, the foregoing problem becomes critical.

The internally and upwardly pushing member 151 which is an element of the separation section 150 and structured to upwards push the portion of the transfer film 109*a* from an internal position is usually located at a standby position in the vicinity of the reverse side of the transfer film 109*a* or disposed in contact with the foregoing reverse side. Therefore, the internally and upwardly pushing member 151 is electrically charged attributable to an influence of the charge on the reverse side of the transfer film 109*a*. As a result, the toner image formed at the leading end of the paper P immediately after the paper P has been separated is disordered. Thus, there arises a problem of unsatisfactory quality of the formed image.

The reason why the quality of the formed image deteriorates attributable to the internally and upwardly pushing member 151 is now described with reference to FIG. 16. In order to transfer, to the paper P, the toner placed on the photosensitive drum 101 and charged negatively, the reverse side of the transfer film 109*a* is positively charged. The positive charge is moved when the transfer drum 109 is rotated so that the positive charge approaches or brought into contact with the internally and upwardly pushing member 151. Therefore, the leading end of the internally and upwardly pushing member 151 is positively charged. As a result, the toner placed on the paper P and having the negative charge is attracted by the positive charge on the surface of the internally and upwardly pushing member 151. Thus, toner flies for a period corresponding to the operation of the internally and upwardly pushing member 151 to form a stripe pattern in a direction opposite to a direction in which the paper P is moved.

When the environment humidity is low, for example, when the relative humidity is 30% or lower, the influence of the applied charge on the reverse side of the transfer film causes the quality of the image at the leading end of the paper immediately after separated to deteriorate critically. The reason for this is that intensification of the surface resistance or volume resistance attributable to drying of the paper lowers an electric current which flows into the transfer film in the environment of low humidity. As a result, the electrostatic force for attracting toner from the photosensitive drum 101 to the paper P is reduced. Therefore, there arises a requirement to raise the transferring electric current in the low humidity environment as compared with the room temperature and room humidity or high temperature and high humidity (for example, 28° C. and 85%). Therefore, the applied charge on the reverse side of the transfer film is enlarged as compared with the environment having room temperature and room humidity and high temperature and high humidity. As a result, the internally and upwardly pushing member 151 is electrically charged with the charge on the reverse side of the transfer film or frictional charge generated when separation has been performed. Thus, the positive charge is enlarged in the low humidity environment as compared with that in the room temperature and room humidity and high temperature and high humidity. Therefore, toner flies excessively in the foregoing environment.

SUMMARY OF THE INVENTION

Accordingly, an object of the present invention is to provide an image forming apparatus capable of preventing vibration of a transfer film caused from the operation of a separating device to prevent irregular density distribution and change in the hue. Further, the present invention prevents disorder of the transfer image on the paper sheet caused by the flying of toner.

The image forming apparatus according to the present invention has: a transfer-medium holding member having a transfer film for adsorbing and carrying a transfer medium and arranged such that an image is formed on the transfer medium; an internally and upwardly pushing member movably disposed on the surface of the transfer film opposite to the surface to which the transfer medium is adsorbed; and moving device for moving the internally and upwardly pushing member by a predetermined quantity so that the internally and upwardly pushing member upwardly pushes the transfer film to deform the transfer film to separate the transfer medium from the transfer film, the image forming apparatus comprising: preventing device for preventing vibration of the internally and upwardly pushing member.

In the present invention, the transfer-medium holding member is required to having the transfer film for adsorbing and carrying the transfer medium to enable an image to be formed on the transfer medium. The transfer-medium holding member may be composed of a pair of rotative transfer rings and a tubular transfer film disposed between the transfer rings. To form an image on the transfer medium carried by the transfer drum, a structure may be employed in which the transfer drum and the transfer corotron are disposed opposite to each other through the transfer film to form a toner image on the photosensitive drum and transfer the toner image to the transfer medium.

The transfer film is required to be capable of adsorbing the transfer medium and deformable by the internally and upwardly pushing member. For example, the transfer film is made of, for example, polyvinylidene fluoride (PVdF) or polyethyleneterephthalate (PET).

The internally and upwardly pushing member is required to be movably provided for the transfer film on the surface (hereinafter called a "reverse side") opposite to the surface of the same to which the transfer medium is adsorbed and capable of upwardly pushing the transfer film. For example, the internally and upwardly pushing member is a cam member rotatively disposed adjacent to the reverse side of the transfer film and capable of upwardly pushing the transfer film.

The moving device for moving the internally and upwardly pushing member is required to move the internally and upwardly pushing member for a predetermined distance to cause the internally and upwardly pushing member to deform the transfer film. For example, the moving device has an internal frame secured in a transfer drum and having a cut hole, a holding member for holding the internally and upwardly pushing member disposed movably in the cut hole and structured to hold the internally and upwardly pushing member and an electromagnetic solenoid for moving the holding member so that the holding member is brought into contact with the surface of the cut hole to swing the internally and upwardly pushing member by a predetermined quantity. As an alternative to this, the moving device is composed of a moved member for holding the internally and upwardly pushing member and arranged in the transfer drum to be moved, a moving force generating member for moving the moved member to be moved, an electromagnetic solenoid disposed in a transfer drum and a movement-distance limiting member disposed in the moved member to be moved and arranged to be brought into contact with another member to limit the distance for which the moved member is moved.

The preventing device for preventing vibration of the internally and upwardly pushing member may be composed of a buffer member disposed between the internally and upwardly pushing member and the transfer film, a buffer member disposed between the internally and upwardly pushing member and the holding member, a buffer member disposed between the cut hole and the holding member or a buffer member disposed between the movement distance limiting member and another member.

The buffer member is required to be deformed when force is applied to the buffer member. It is preferable that the buffer member be an elastic member having a repeated and stable buffering characteristic for a long period. The elastic member is, for example, a foaming material, such as urethane, a leaf spring or a coil spring. The elastic force of the elastic member is preferable that the elastic member is difficult to deform when the force acting on the internally and upwardly pushing member is applied to the elastic member in case that the internally and upwardly pushing member is brought into contact with the transfer film and that the elastic member is capable of easily deforming when the force acting on the internally and upwardly pushing member is applied to the elastic member in the deformed state of the transfer film. As a result, impact generating when the internally and upwardly pushing member upwardly push the transfer film can be weakened and thus vibration of the transfer film can be prevented.

Since the image forming apparatus according to the present invention has the preventing device for preventing vibration of the internally and upwardly pushing member, vibration of the internally and upwardly pushing member can be prevented when the internally and upwardly pushing member is brought into contact with the transfer drum.

According to another aspect of the present invention, there is provided a separating apparatus of a multiple transfer apparatus structured to perform multiple transference by electrostatically adsorbing paper to a transfer film formed into a drum shape and separate the paper from the transfer film by upwards pushing the transfer film from an inner position of the transfer film by a internally and upwardly pushing member after the multiple transference has been performed, wherein control device for preventing storage of charges occurring due to an influence of the transfer film is provided for a portion of the internally and upwardly pushing member adjacent to the transfer film or a portion of the internally and upwardly pushing member which is brought into contact with the transfer film.

Further, in the present invention, the internally and upwardly pushing member is made of a charging material of a type which is electrically charged to have a polarity opposite to the charge of the transfer film.

Further, in the present invention, the internally and upwardly pushing member is made of resin which is negatively charged.

Further, in the present invention, the internally and upwardly pushing member is made of fluororesin or resin containing a fluorine component.

Further, in the present invention, the internally and upwardly pushing member is a rotational roll.

In the present invention further includes a grounded conductive brush which is brought into contact with the roll.

BRIEF DESCRIPTION OF THE DRAWING FIGURES

Figure 6:
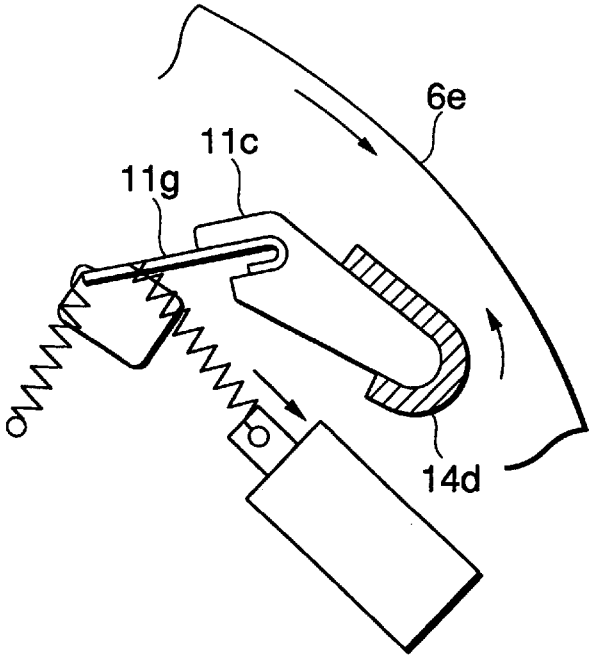
Figure 7:
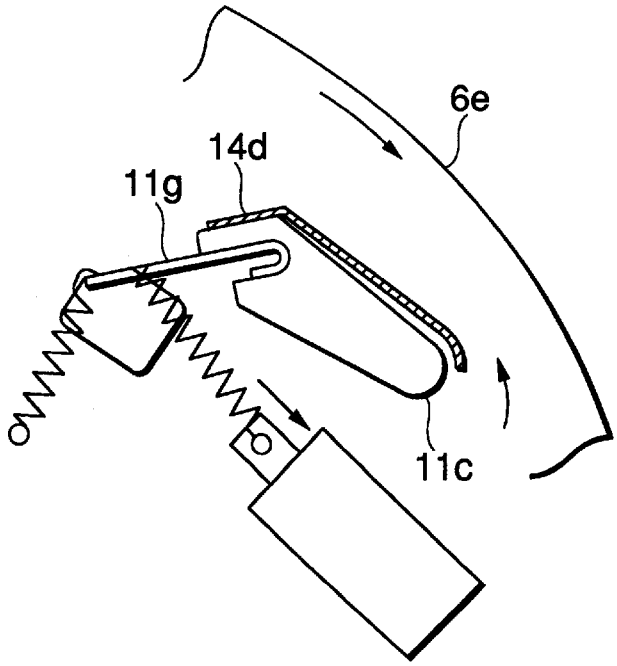
Figure 8A:
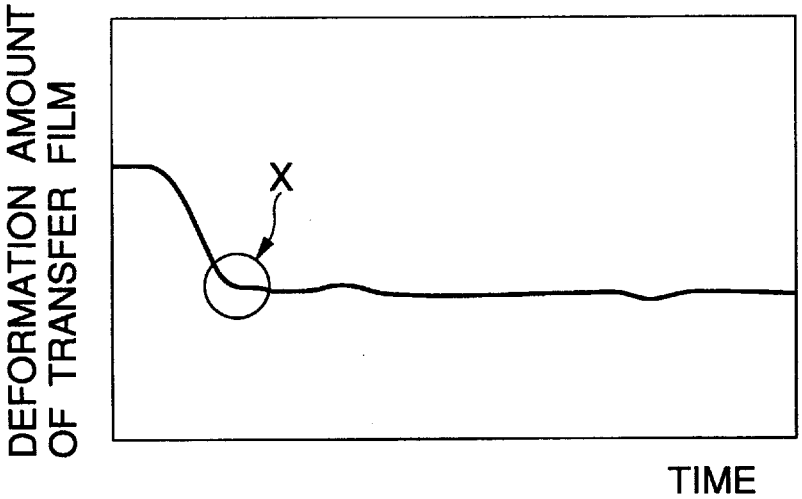
Figure 8B:
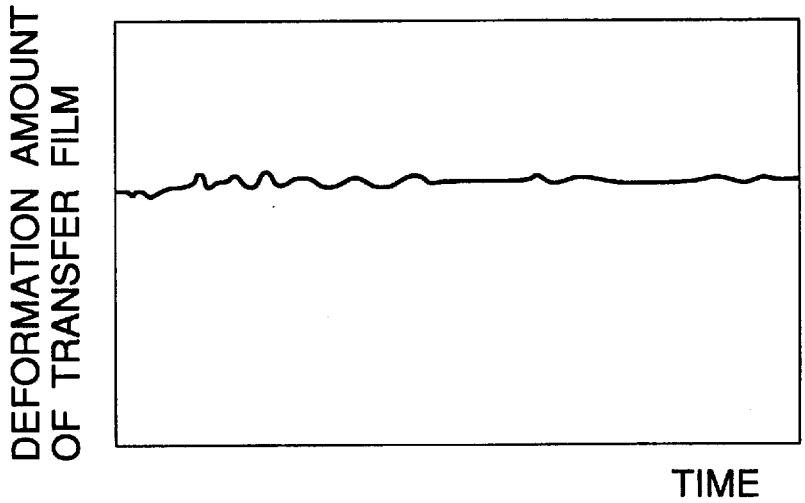
Figure 9A:
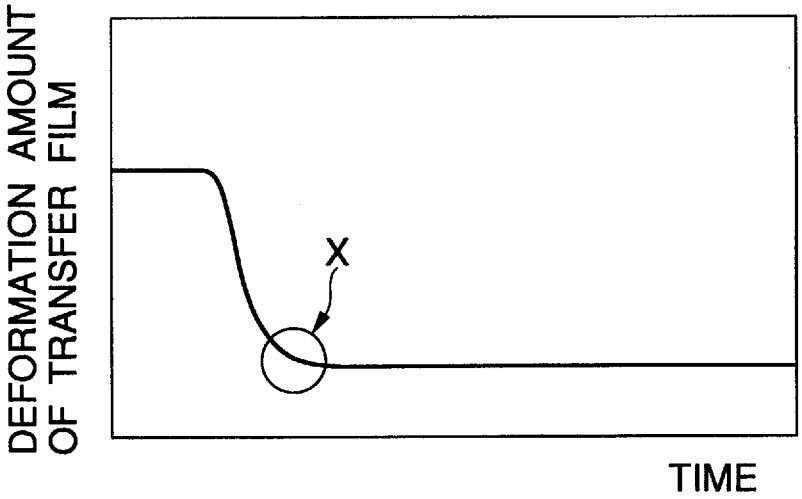
Figure 9B:
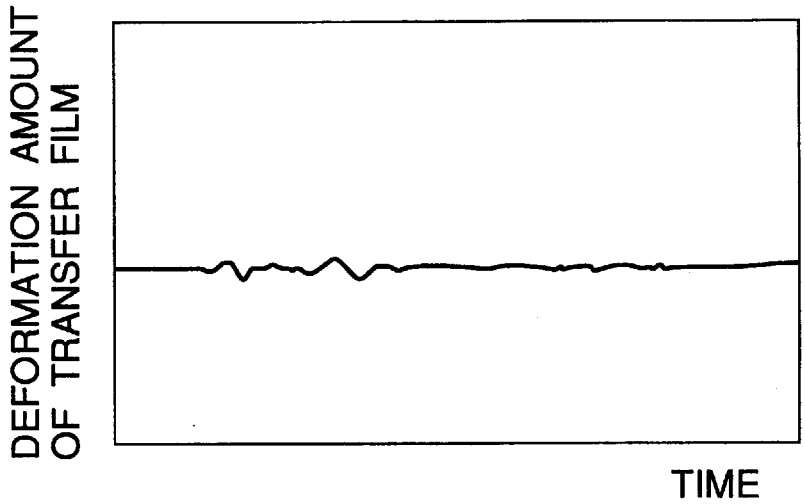
Figure 10A:
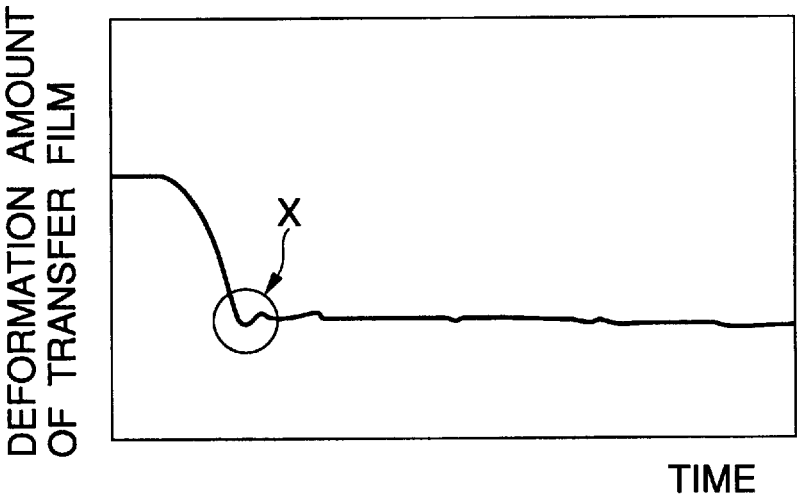
Figure 10B:
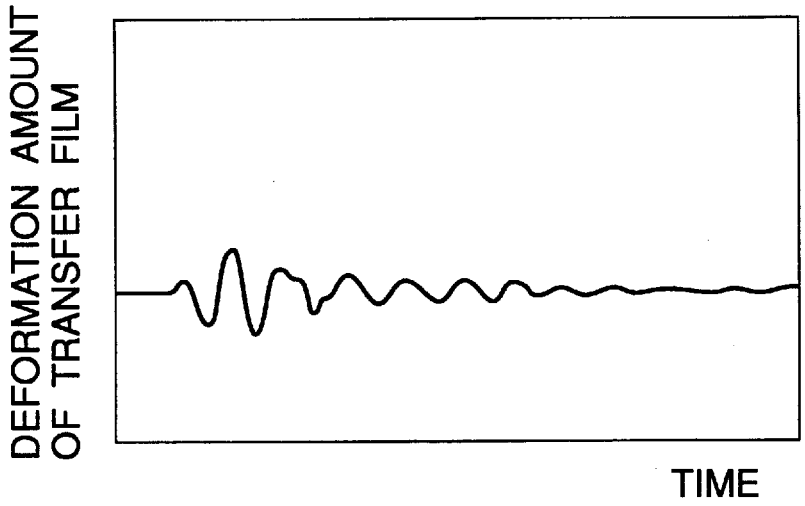
Figure 11:
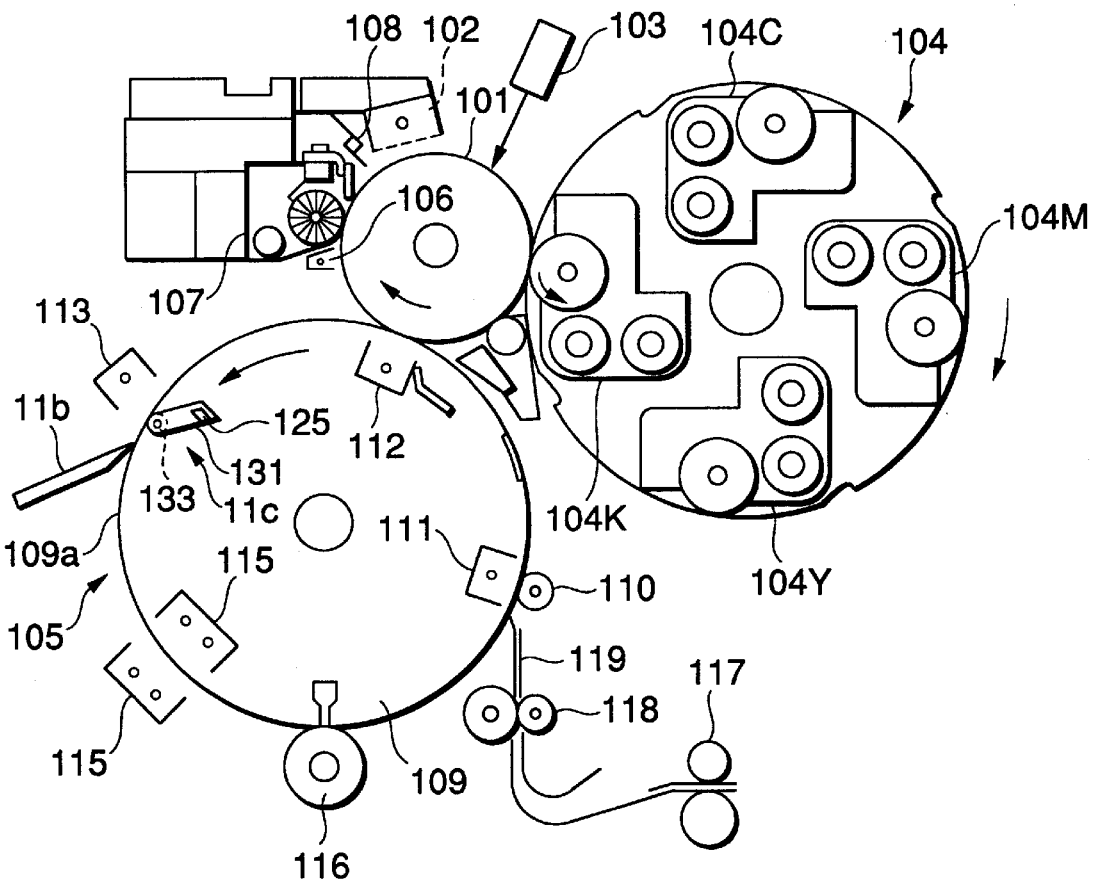
Figure 12:
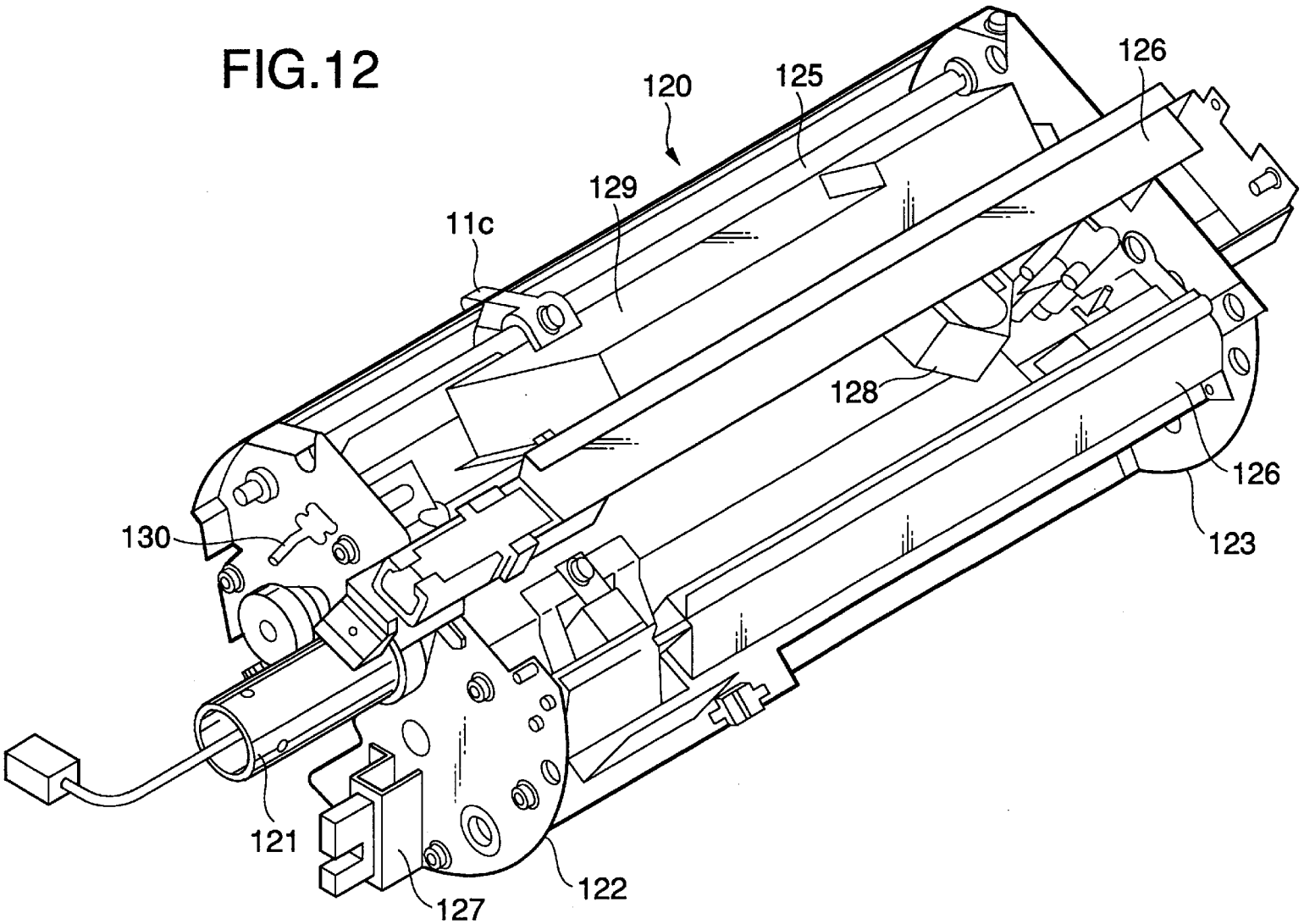
Figure 13A:
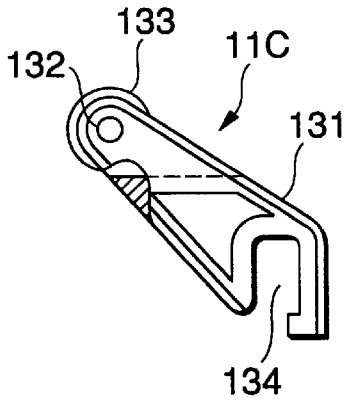
Figure 13B:
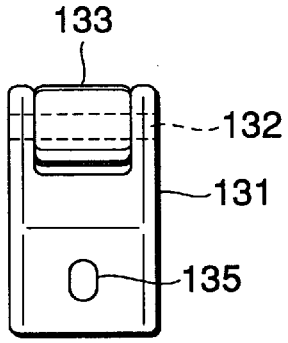
Figure 14:
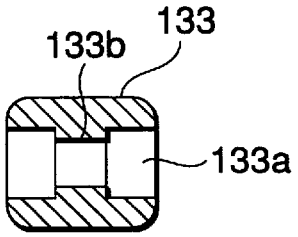
Figure 15:
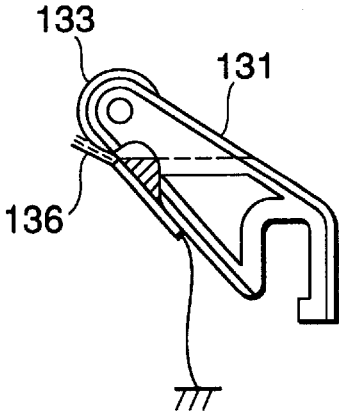
Figure 16:
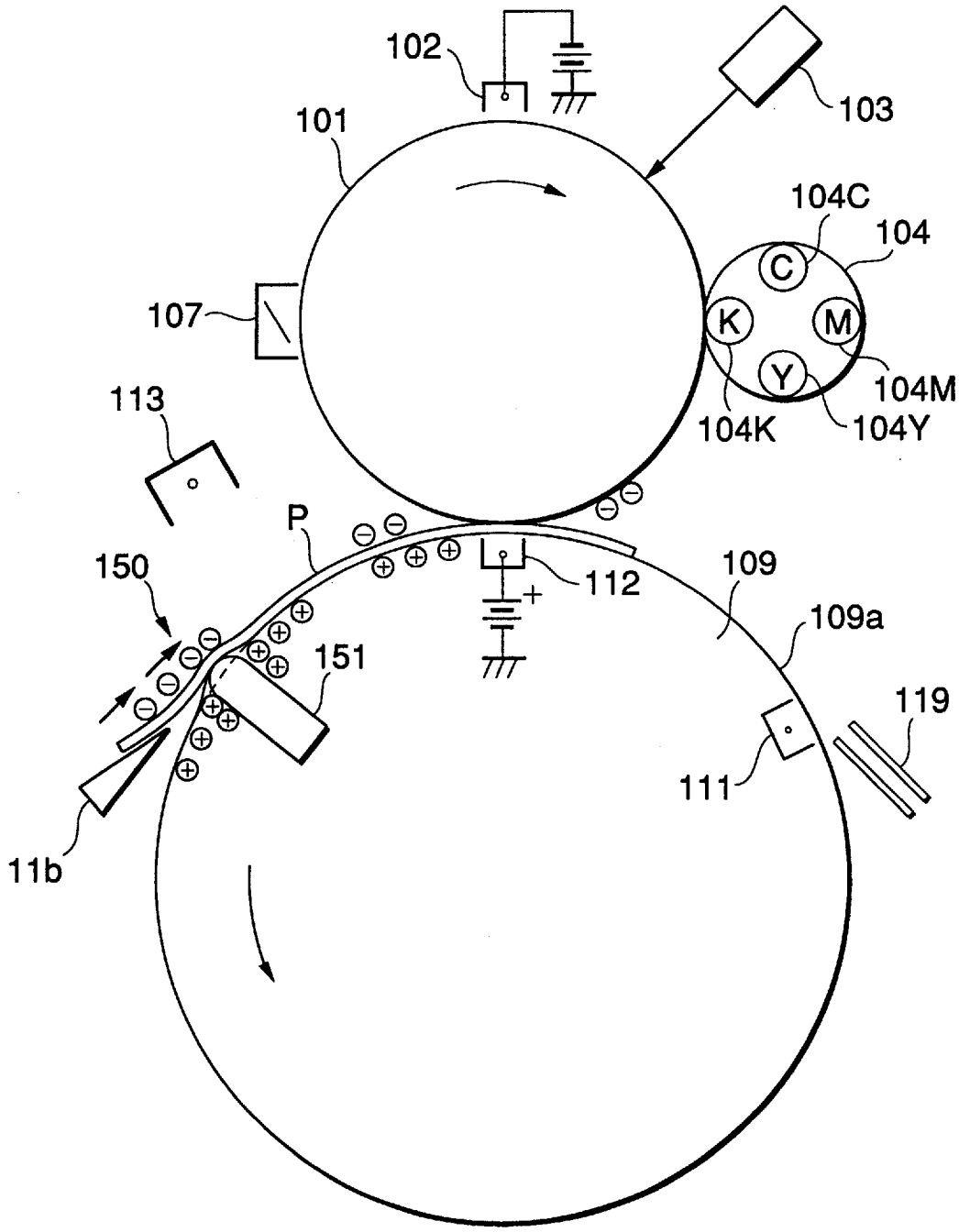

FIG. 6 a diagram showing a countermeasure (soft urethane foam) to absorb vibrations employed in a third embodiment;

FIG. 7 is a diagram showing a countermeasure (leaf spring) to absorb vibrations employed in the third embodiment;

FIGS. 8A and 8B are graphs showing a state of vibration of a transfer film in the image forming apparatus shown in FIG. 6, in which FIG. 8A shows vibrations at a pushed position and FIG. 8B shows those at the transferred position;

FIGS. 9A and 9B are graphs showing a state of vibration of a transfer film in the image forming apparatus shown in FIG. 7, in which FIG. 9A shows vibrations at a pushed position and FIG. 9B shows those at the transferred position;

FIGS. 10A and 10B are graphs showing a state of vibration of a transfer film in conventional image forming apparatus (according to Comparative Example 1) shown in FIG. 6, in which FIG. 10A shows vibrations at a pushed position and FIG. 10B shows those at the transferred position;

FIG. 11 is a schematic cross sectional view showing an embodiment of the image forming apparatus according to the present invention;

FIG. 12 is a diagram showing an assembly disposed in the inside portion of the transfer drum for use in the image forming apparatus shown in FIG. 11;

FIGS. 13A and 13B are a side view and a front view showing only the internally and upwardly pushing member adapted to the assembly in the transfer drum shown in FIG. 12;

FIG. 14 is a cross sectional view showing a roll for use in the internally and upwardly pushing member shown in FIG. 13;

FIG. 15 is a side view showing an example of the internally and upwardly pushing member; and FIG. 16 is a schematic cross sectional view showing an example of a color image forming apparatus in a multiple transfer apparatus comprising a transfer drum.

DESCRIPTION OF THE PREFERRED EMBODIMENTS OF THE INVENTION

Referring to the drawings, embodiments of an image forming apparatus according to the present invention is now described.

First Embodiment

Figure 1:
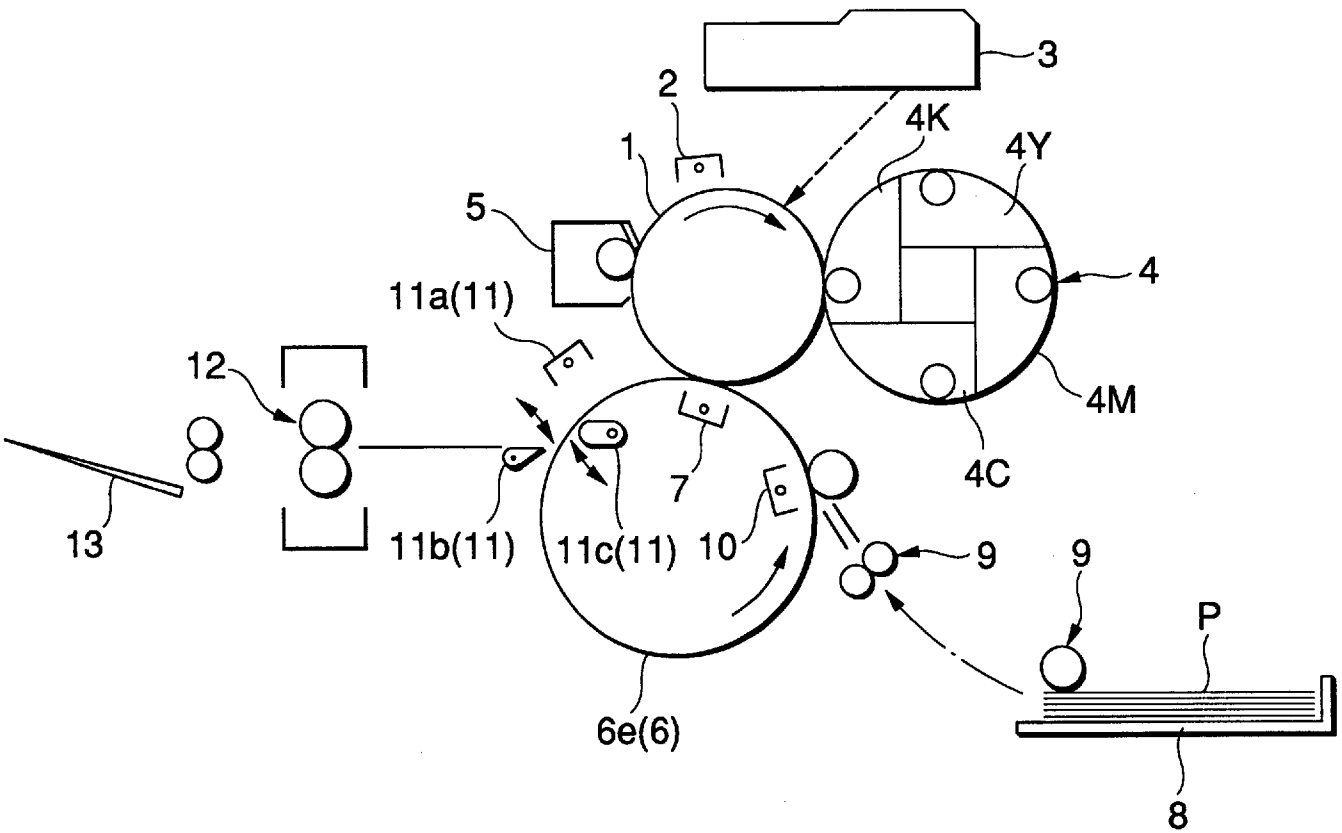
FIG. 1 is a schematic view showing an image forming apparatus according to a first embodiment of the present invention.

FIG. 1 shows a full color image forming apparatus according to this embodiment.

The image forming apparatus has a monochrome-toner-image forming portion provided with one photosensitive drum 1 and accommodating black toner, yellow toner, magenta toner and cyan toner to sequentially form toner images in the respective colors on the surface of the photosensitive drum 1; and a image forming portion having a transfer drum 6 disposed opposite to the photosensitive drum 1 and adsorbing and holding transfer medium P so that the monochrome toner images formed on the photosensitive drum 1 are sequentially transferred to the surface of the transfer medium P and thus an image is formed on the transfer medium P.

The monochrome-toner-image forming portion has the rotative photosensitive drum 1, a charging corotron 2 for charging the photosensitive drum 1 to have a uniform potential, an exposing unit 3 for exposing the photosensitive drum 1 in accordance with image information in respective colors, a developing unit 4 for holding the four color toners and supplying the color toners to the photosensitive drum 1 and a photosensitive-member cleaning unit 5 for cleaning the photosensitive drum 1.

The developing unit 4 has four developing parts 4K, 4Y, 4M and 4C for accommodating corresponding color toners and supplying the toners to the photosensitive drum 1. A developing unit (which is 4K in the structure shown in FIG. 1) corresponding to image information is caused to face the photosensitive drum 1 so as to supply the toner in the corresponding color.

The monochrome-toner-image forming portion forms a latent image on the photosensitive drum 1 by operating the charging corotron 2 and the exposing unit 3 in a state where the photosensitive drum 1 is rotated. Then, the developing unit 4 develops the latent image so that the monochrome-toner-image forming portion forms monochrome toner images in the respective colors on the photosensitive drum 1.

The image forming portion has the rotative transfer drum 6 disposed opposite to the photosensitive drum 1, a transfer corotron 7 disposed opposite to the photosensitive drum 1 through the transfer drum 6 and capable of forming a transferring electric field in a space between the photosensitive drum 1 and the transfer corotron 7, a transfer-medium accommodating tray 8 for accommodating a multiplicity of transfer mediums P, a transfer-medium supply and moving member 9 for moving the transfer medium P from the transfer-medium accommodating tray 8 to the transfer drum 6, an adsorbing charger 10 for electrostatically adsorbing the transfer medium P to the transfer drum 6, a separating device 11 for separating the transfer medium P from the transfer drum 6, a fixing unit 12 for fixing the toner image to the transfer medium P and a transfer-medium tray 13 to which the transfer medium P is discharged. The position between the photosensitive drum 1 and the transfer corotron 7 is defined to be a transference position.

Figure 2:
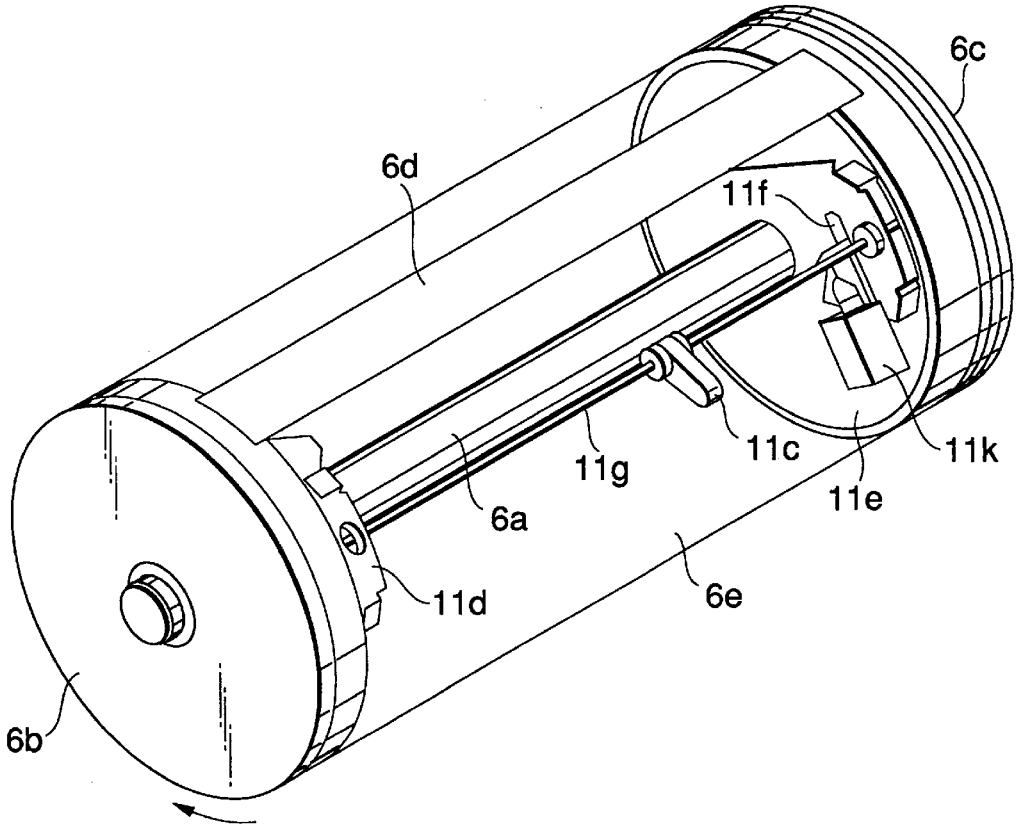
FIG. 2 is a perspective view showing a transfer drum unit for use in the image forming apparatus shown in FIG. 1.

As shown in FIG. 2, the transfer drum 6 has a fixed transfer drum shaft 6*a*, a pair of transfer rings 6*b* and 6*c* disposed rotatively around the transfer drum shaft 6*a*, a ring tie plate 6*d* for connecting the two transfer rings 6*b* and 6*c* to each other and a tubular transfer film 6*e* disposed between the two transfer rings 6*b* and 6*c*. Thus, the transfer drum 6 adsorbs the transfer medium P to the surface of the transfer film 6*e*.

The separating device 11 has a destaticizing corotron 11*a* disposed on the outside of the transfer film 6*e* and structured to destaticize the transfer film 6*e* and the transfer medium P when the transfer medium P is separated, a movable separation claw 11*b* disposed more downstream of the transfer drum 6 than the destaticizing corotron 11*a* in a direction in which the transfer drum 6 is rotated to press the transfer film 6*e* from an outer position when the transfer medium P is separated, an internally and upwardly pushing member 11*c* disposed movably more upstream of the transfer drum shaft 6*a* than the separation claw 11*b* in the direction in which the transfer drum shaft 6*a* is rotated and structured to press the transfer film 6*e* from an inner position when the transfer medium P is separated and a swinging device structured to swing the internally and upwardly pushing member 11*c*. When the transfer medium P is separated, the destaticizing corotron 11*a* reduces the electrostatic adsorbing force of the transfer medium P with respect to the transfer film 6*e*. The internally and upwardly pushing member 11*c* deforms the transfer film 6*e* to form a gap between the transfer film 6*e* and the transfer medium P. Then, the separation claw 11*b* is inserted between the transfer film 6*e* and the transfer medium P so that the transfer medium P is separated from the transfer drum 6.

Then, the image forming portion causes the transfer-medium supply and moving member 9 to feed the transfer medium P from the transfer-medium accommodating tray 8 to the transfer drum 6. Then, the adsorbing charger 10 causes the transfer medium P to be adsorbed to the transfer drum 6, and then the separating device 11 separates the transfer medium P from the transfer drum 6. Then, the transfer medium P is discharged to the transfer-medium tray 13 through the fixing unit 12.

Therefore, the image forming apparatus according to this embodiment is structured such that four monochrome toner images are sequentially formed on the photosensitive drum 1, and then the four monochrome toner images are sequentially stacked and transferred to the surface the transfer medium P by the transfer corotron 7, and then the transfer medium P is separated from the transfer drum 6 by the separating device 11, and then the transfer medium P is discharged to the transfer-medium tray 13 through the fixing unit 12 so as to form a full color image on the transfer medium P.

The image forming apparatus according to this embodiment has the internally and upwardly pushing member 11*c* formed by a cam member rotatively disposed adjacent to the reverse side of the transfer film 6*e* and arranged to upwards push the transfer film 6*e* when the cam member is rotated. Moreover, the swinging device is formed by a pair of internal frames 11*d* and 11*e* secured to the transfer drum shaft 6*a* and having cut holes 11*f*, a steel plate 11*g* for holding the internally and upwardly pushing member 11*c* and movably arranged within the pair of the cut holes 11*f*, a first spring 11*h* for returning the internally and upwardly pushing member 11*c* to a retraction position when the ring tie plate 6*d* has been brought into contact with the internally and upwardly pushing member 11*c*, an electromagnetic solenoid 11*k* having a sliding member 11*i* and a sliding force generating member 11*j* for moving the sliding member 11*i*, and a second spring 11*m* for establishing the connection between the sliding member 11*i* and the steel plate 11*g* for holding the internally and upwardly pushing member 11*c*.

Figure 3A:
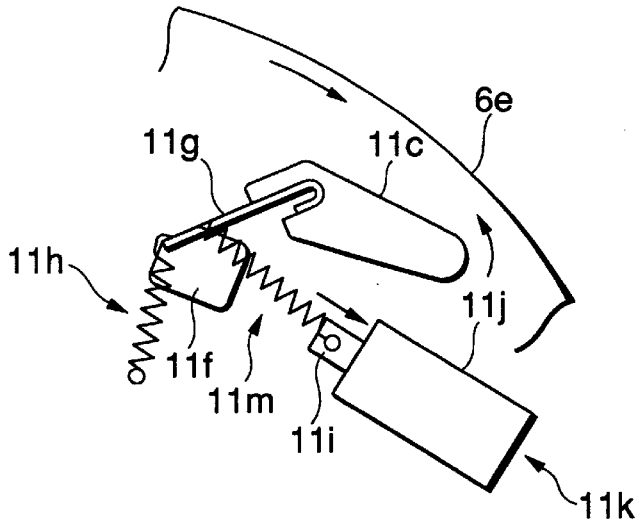
FIGS. 3A to 3C are diagrams showing the operation of the internally and upwardly pushing member of the image forming apparatus shown FIG. 1.
Figure 3B:
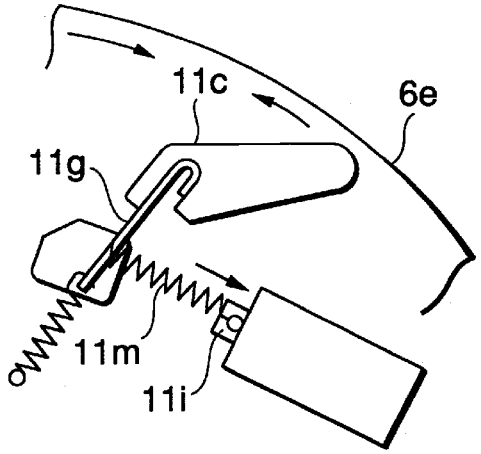
Figure 3C:
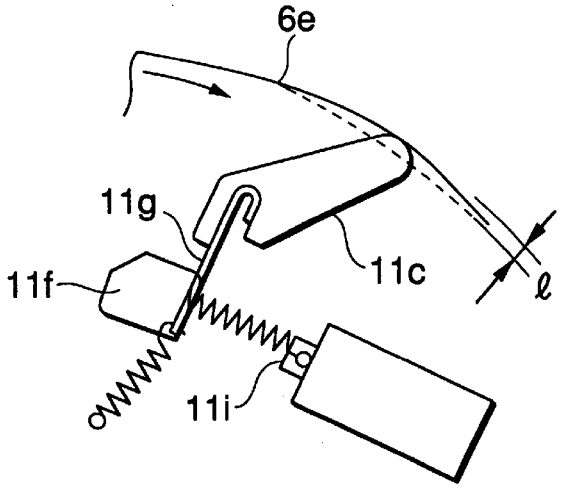

The image forming apparatus according to this embodiment, as shown in FIG. 3, has a structure such that the operation of the electromagnetic solenoid 11*k* for introducing the sliding member 11*i* causes the second spring 11*m* to be pulled so that the steel plate 11*g* for holding the internally and upwardly pushing member 11*c* is rotated. As a result, the internally and upwardly pushing member 11*c* is moved, thus causing the transfer film 6*e* to be pushed upwards.

The internally and upwardly pushing member 11*c* pushes the transfer film 6*e* from an inside position to deform the transfer film 6*e* . The deformation amount of the transfer film 6*e* is determined by the degree of contact of the steel plate 11*g* for holding the internally and upwardly pushing member 11*c* with the surface of the cut hole 11*f* (see FIG. 3C).

Figure 4:
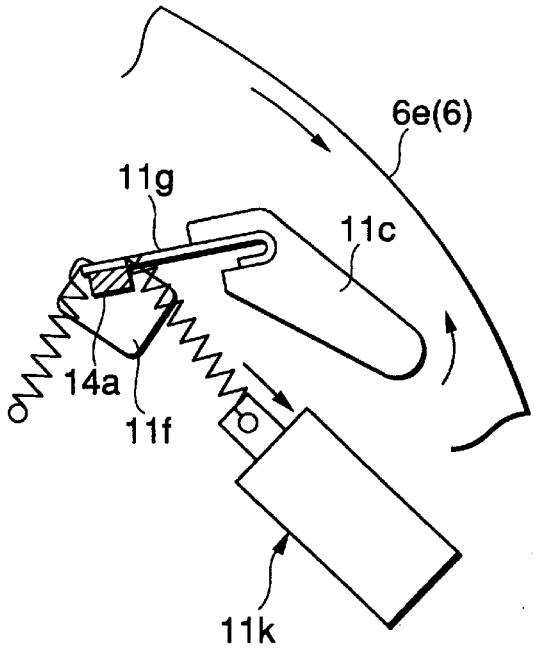
FIG. 4 is a diagram showing a countermeasure (soft urethane foam) to absorb vibrations employed in a first embodiment.
Figure 5:
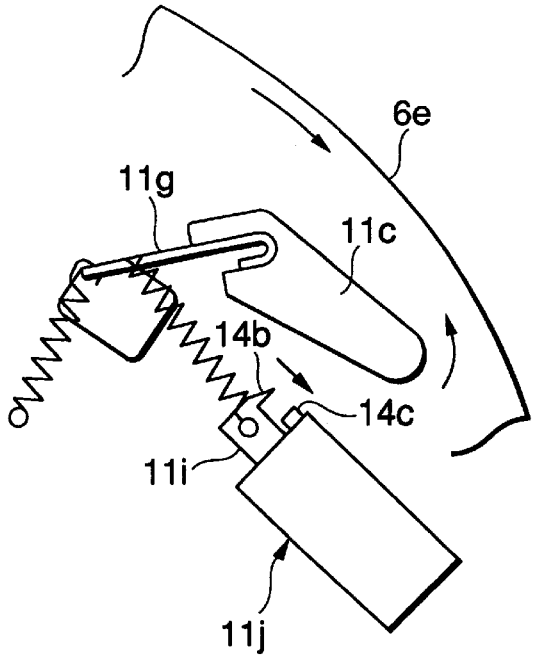
FIG. 5 is a diagram showing a countermeasure to absorb vibrations employed in the second embodiment.

In this embodiment, an elastic member 14*a* is, as shown in FIG. 4, bonded to the steel plate 11*g* . Moreover, the steel plate 11*g* is brought into contact with the surface of the cut hole 11*f* through the elastic member 14*a*. Then, defects in the formed images, such as an unsatisfactory color quality caused from rubbing and change in the hue of the formed image occurring when the separating device 11 was operated, were observed. Materials of the elastic member 14*a* were urethane, damper, silicon rubber and sponge as shown in Table 1.

As a result, any critical defect in the image quality did not take place regardless of the material. In the cases where the damper, silicon rubber and sponge were employed, no defect in the image quality took place regardless of the material of the transfer medium (including an OHP sheet).

Moreover, time taken for the internally and upwardly pushing member 11*c* to be stabilized was measured. As a result, a too long time was required when the damper was employed. Thus, a fact was found that the silicon rubber and sponge were preferred materials.

In this embodiment, the thickness of the sponge was, as shown in Table 2, varied to 1.0 mm, 1.5 mm, 2.0 mm and 3.0 mm and similar experiments were performed.

As a result, satisfactory results free from any defect in the quality of the formed image were obtained with the above-mentioned image forming apparatus when the thickness of the sponge was 2.0 mm or larger.

Comparative Example 1

An image forming apparatus similar to that according to the first embodiment was employed except for the elastic member 14*a* being omitted from the steel plate 11*g* for holding the internally and upwardly pushing member.

Similar experiments to those according to the first embodiment were performed.

As a result, the image forming apparatus according to Comparative Example 1 encountered critical defects in the quality of the formed images, such as a defect caused from rubbing and change in the hue, as shown in Table 1.

TABLE 1

| Type of Elastic Member | Defect in the Quality of Image | Time Required to be Stabilized (ms) |
|---|---|---|
| Urethane | Allowable | 14 |
| Damper | Satisfactory | 39 |
| Silicon | Satisfactory | 13 |
| Sponge | Satisfactory | 12 |
| No Elastic Member | Unsatisfactory | 15 |

TABLE 2

| Thickness of Sponge (mm) | Defect in the Quality of Image |
|---|---|
| 1.0 | Satisfactory |
| 1.5 | Satisfactory |
| 2.0 | Excellent |
| 3.0 | Excellent |

Second Embodiment

An image forming apparatus similar to that according to the first embodiment was employed except for the below two points. A movement-distance limiting member 14*b* is provided in the sliding member 11*i* in place of the structure in which the elastic member was provided in the steel plate 11*g* for holding the internally and upwardly pushing member 11*c*. Moreover, a movement-distance limiting member 14*b* is arranged so as to bring the movement-distance limiting member 14*b* into contact with the sliding force generating member 11*j* of the electromagnetic solenoid through the elastic member 14*c*.

Similar experiments were performed to those according to the first embodiment.

As a result, the image forming apparatus according to this example was free from any critical defect in the quality of the formed image. When damper, silicon rubber and the sponge were employed, no defect in the quality of the formed image took place regardless of the type of the transfer medium P (including an OHP sheet).

Third Embodiment

As shown in FIGS. 6 and 7, a similar image forming apparatus to that according to the first embodiment was employed except for a structure in which an elastic member 14*d* was provided in the internally and upwardly pushing member 11*c* in place of an arrangement in which the elastic member was provided for the steel plate 11*g*, to thereby cause the internally and upwardly pushing member 11*c* to be brought into contact with the transfer film 6*e* through the elastic member 14*d*.

In this example, soft urethane foam or a leaf spring was employed as the elastic member 14*d*, and then similar experiments to those according to first embodiment were performed.

When the soft urethane foam was employed to form the elastic member 14*d*, a double-coated tape was employed to bond the elastic member 14*d* to the point of contact with the internally and upwardly pushing member 11*c* and a portion surrounding the point of contact, as shown in FIG. 6. When a phosphor bronze plate (the leaf spring) having a thickness of 0.2 mm was employed as the elastic member 14*d*, an end of the phosphor bronze plate was, as shown in FIG. 7, secured to a position near a support point of the internally and upwardly pushing member 11*c*.

Similar experiments to those according to the first embodiment were performed.

As a result, the image forming apparatus according to this example was free from any critical defect in the quality of the formed image regardless of the type of the transfer medium P (including an OHP sheet).

For reference, a state where the transfer film 6*e* was changed in each of the two image forming apparatuses having the respective elastic members 14*d* and a state of-the transfer film 6*e* of the image forming apparatus according to Comparative Example 1 having no elastic member are shown in FIGS. 8A to 10B.

In FIGS. 8A to 10B, graph A shows a state of change of the transfer film 6*e* which has occurred at a position at which the amount of upward pushing was measured, and graph B shows a state of change of the transfer film 6*e* at the position of transference. FIGS. 8A and 8B show a state of change of the transfer film 6*e* when the soft urethane foam was employed to form the elastic member 14*d*, FIGS. 9A and 9B show a state of change of the transfer film 6*e* when the leaf spring was employed as the elastic member 14*d*, and FIG. 10A and 10B show a state of change of the transfer film 6*e* of the image forming apparatus according to Comparative Example 1 having no elastic member.

As can be understood from the above-mentioned graphs indicating the changes, the transfer film 6*e* was vibrated at the upwardly pushed position (refer to portion X of FIG. 10A) in the image forming apparatus encountered the defect in the quality of the formed image and shown in FIGS. 10A and 10B. It caused the transfer film 6*e* to be vibrated at the transference position. On the other hand, the transfer film 6*e* of each of the image forming apparatuses free from the foregoing defect in the quality of the formed image and shown in FIGS. 8A to 9B were free from vibrations at the upwardly pushed position (refer to portion X of A in each of FIGS. 8 and 9). Thus, the transfer film 6*e* was not vibrated considerably at the transference position.

Fourth Embodiment

FIG. 11 is a schematic cross sectional view showing an image forming apparatus according to the present invention. Referring to FIG. 11, a charging unit 102, an exposing unit 103, a developing unit 104, a transfer unit 105, a post-cleaning corotron 106, a cleaning unit 107, a destaticizing lamp 108 and the like are, in this sequential order, disposed around the photosensitive drum 101 which is an image carrier.

The developing unit 104 has four color developing parts 104K, 104Y, 104M and 104C corresponding to four colors, that is, black, yellow, magenta and cyan. Any one of the color developing unit is selectively brought into contact with the photosensitive drum 101 so that an electrostatic latent image on the surface of the photosensitive drum 101 is developed by the color toner.

The transfer unit 105 has a transfer drum 109 which is a transfer-medium holding member arranged to be brought into contact with the photosensitive drum 101. An adsorbing roll 110 having an adsorbing portion and an adsorbing corotron 111 for causing paper which is the transfer medium to be adsorbed to the surface of the transfer drum 109, a transfer corotron 112 for transferring a toner image on the photosensitive drum 101 to the surface of the transfer drum 109 and causing the paper to be allowed to adhere to the surface of the transfer drum 109 in a case where the adsorbing roll 110 and the adsorbing corotron 111 are omitted from the structure, a separating corotron 113 and a separation claw 11*b* for separating the paper from the surface of the transfer drum 109, a destaticizing unit 115 for destaticizing residual charges on the transfer drum 109, a cleaning unit 116 and the like are disposed around the transfer drum 109.

Paper in a paper feeding tray (not shown) is, by paper feeding rolls 117, supplied to the transfer unit 105, and then allowed to pass through a paper chute 119 by a moving roll 118 so as to be introduced between the adsorbing roll 110 and the surface of the transfer drum 109.

The basic operation of the above-mentioned image forming apparatus is now described.

The photosensitive drum 101 is uniformly charged by the charging unit 102 in a charging cycle. Then, a black latent image is formed at a predetermined position on the photosensitive drum 101 by a laser beam emitted from the exposing unit 103. Then, the developing unit 104 is rotated so that the black developing part 104K is moved to a position at which the black developing part 104K faces the photosensitive drum 101 and applied with a predetermined bias voltage. As a result, toner having a charge is selectively shifted to the surface of the photosensitive drum 101 so that a latent image is formed. At this time, the laser beam is used to write the image portion so that the toner having the polar charge which is the same as the polarity of the surface potential of the photosensitive drum 101 charged by the charging unit 102 is allowed to adhere to the portion of the photosensitive drum 101 irradiated with the laser beam so that a toner image is formed.

When the paper, which has been moved along the paper chute 119, passes through a position at which the adsorbing corotron 111 and the adsorbing roll 110 face each other, electric power is discharged. Thus, the paper is electrically adsorbed to the surface of the transfer drum 109. If the adsorbing corotron 111 is omitted from the structure, the transfer corotron 112 causes the paper to be electrically adsorbed to the surface of the transfer drum 109. The toner image on the photosensitive drum 101 is moved to a position at which the toner image faces the transfer drum 109. Moreover, the toner image is brought into contact with the paper adsorbed to the surface of the transfer drum 109. Then, the transfer corotron 112 transfers the toner image to the paper. Residual toner on the photosensitive drum 101 is adjusted to have an appropriate quantity of charge by the post-cleaning corotron 106, and then removed by the cleaning unit 107. The residual charge on the photosensitive drum 101 is removed by the destaticizing lamp 108.

Then, a second cycle is performed such that the photosensitive drum 101 is again charged by the charging unit 102. Then, a laser beam corresponding to a yellow image is emitted from the exposing unit 103 to a predetermined position on the photosensitive drum 101. On the other hand, the developing unit 104 is rotated so that the yellow developing part 104Y is moved to a position at which the yellow developing part 104Y faces the photosensitive drum 101. Moreover, bias voltage is applied to the yellow developing part 104Y so that yellow toner is shifted to a portion of the photosensitive drum 101 which has been irradiated with the laser beam so that development is performed. The developed toner image is stacked and transferred onto the black image carried by the transfer drum 109.

Then, a similar third cycle is performed such that a magenta image is formed, and a fourth cycle is performed such that a black image is formed. Then, a multi-color toner image is formed by stacking black, yellow, magenta and cyan toner images on the paper held by the transfer drum 109. The paper having the multi-color image formed thereon is separated from the transfer drum 109 by the separating corotron 113 and the separation claw 11*b,* and then heated and pressurized by a fixing unit (not shown) so that the toner image is fixed. As a result, one copy image is formed. An excessive charge on the right side and the reverse side of the paper is destaticized by the destaticizing unit 115 after the paper has been separated. Then, the transfer drum 109 is cleaned by the unit for cleaning the transfer member, and then again moved to the position at which the transfer drum 109 adsorbs paper.

FIG. 12 shows an assembly 120 in the transfer drum 109 disposed in the transfer drum 109 for use in the image forming apparatus shown in FIG. 11. The assembly 120 in the transfer drum 109 is mainly composed of a fixed shaft 121, a pair of circular support plates 122 and 123 attached to the fixed shaft 121 apart from each other for a predetermined distance, a rotational shaft 125 rotatively supported between the pair of support plates 122 and 123 and having, at an intermediate position thereof, a rectangular cross section to which the internally and upwardly pushing member 11*c* is attached, a transfer corotron rail 126, an image write reference-signal generating sensor 127, a transfer corotron buffer moving member 128, a high voltage circuit 129 for the destaticizing corotron and a member 130 for locating the internally and upwardly pushing member 11*c*.

FIGS. 13A and 13B are a side view and a front view showing the structure of only the internally and upwardly pushing member 11*c* for use in the assembly 120 in the transfer drum 109 shown in FIG. 12.

The internally and upwardly pushing member 11*c* comprises a support arm 131 formed into a wedge shape having a rounded leading end, and a roll 133 supported at the leading end of the support arm 131 by a metal shaft 132. The support arm 131 has, in the base portion thereof, a rectangular attaching hole 134 arranged to be engaged to a rotational shaft 125 having a rectangular cross section. In-a state where the rotational shaft 125 has been engaged to the attaching hole 134, the support arm 131 is secured to the rotational shaft 125 though the thread hole 135 with a screw. Thus, the support arm 131 is secured to the rotational shaft 125. The rotational shaft 125 elastically urged by a spring (not shown) in a direction in which the leading end of the support arm 131 is separated from the transfer film 109*a* is rotated in a direction in which the rotational shaft 125 presses the transfer film 109*a* through a link mechanism or the like by a solenoid (not shown) provided for the assembly 120 in the transfer drum 109.

In this embodiment, the diameter of the roll 133 is 8 mm and the curvature radius of the rounded portion at the leading end of the support arm 131 is 3.5 mm. That is, the roll 133 at the leading end has a larger diameter by 0.5 mm. The reason for this is that only the rotating roll is brought into directly contact with the inner surface of the transfer film to generate only rolling friction in which friction can be reduced so as to minimize the quantity of frictional charge of the roll 133.

The material of the roll 133 must be resin of a type which is negative charged. For example, fluorine resin, such as Teflon or PFA, or resin containing a fluorine component may be employed. The latter material has a structure such that fluorine is contained in polyacetal resin by 10% or more. Also the support arm 131 may be made of the foregoing material as well as the roll 133.

The restricting device for restricting the quantity of charge of the roll at the leading end may be structured such that a grounded conductive brush 136 is brought into contact with the roll 133 to destaticize charges, as shown FIG. 15.

In the case of the conventional internally and upwardly pushing member (made of POM), the transfer film at the position of the internally and upwardly pushing member is positively charged to 2000 V or higher. The surface potential is made to be −500 V to 2000 V in accordance with the material, shape and addition of the destaticizing brush. The relative potential is adjusted such that the quantity of negative charge is enlarged and the positive charge is reduced so that flying of toner is prevented.

Since the image forming apparatus according to the present invention has the preventing device for preventing vibration of the internally and upwardly pushing member as described above, the internally and upwardly pushing member is not vibrated when the internally and upwardly pushing member is brought into contact with the transfer drum. Therefore, the surface of the member for holding the transfer medium is not vibrated so that irregular color density distribution and change in the hue are prevented. Since the preventing device for preventing accumulation of charges caused from influence of the transfer film, for example, the roll which is negatively charged, is provided for the internally and upwardly pushing member, the internally and upwardly pushing member can be charged positively. As a result, disorder of transference on paper caused from flying of toner taking place due to charge of the internally and upwardly pushing member can be prevented.

The foregoing description of the preferred embodiments of the invention has been presented for the purpose of illustration and description only. It is not intended to be exhaustive or to limit the invention to the precise form disclosed, and modifications and variations are possible in light of and within the scope of the invention. The preferred embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and equivalents thereof.

What is claimed is:

1. An image forming apparatus comprising:

a transfer-medium holding member having a transfer film for adsorbing and carrying a transfer medium and arranged such that an image is formed on said transfer medium;

an internally and upwardly pushing member movably disposed on a surface of said transfer film opposite to a surface to which the transfer medium is adsorbed;

moving means for moving said internally and upwardly pushing member by a predetermined quantity so that said internally and upwardly pushing member upwardly pushes said transfer film to deform said transfer film to separate the transfer medium from said transfer film; and preventing means for preventing vibration of said internally and upwardly pushing member.

2. An image forming apparatus according to claim 1, wherein said moving means has an internal frame secured in a transfer drum and having a cut hole, a holding member for holding said internally and upwardly pushing member disposed movably in said cut hole and structured to hold said internally and upwardly pushing member and an electromagnetic solenoid for moving said holding member so that said holding member is brought into contact with the surface of said cut hole to move said internally and upwardly pushing member by a predetermined quantity, and wherein said preventing means is composed of a buffer member disposed between said cut hole and said holding member.

3. An image forming apparatus according to claim 1, wherein said moving means is composed of a moved member for holding said internally and upwardly pushing member and arranged to be moved, a moving force generating member for moving said moved member to be moved, an electromagnetic solenoid disposed in a transfer drum and a movement-distance limiting member disposed in said moved member and arranged to be brought into contact with a second member to limit the distance for which said moved member is moved, and wherein said preventing means is composed of a buffer member disposed between said movement-distance limiting member and the second member.

4. An image forming apparatus according to claim 1, wherein said preventing means is composed of a buffer member disposed between said internally and upwardly pushing member and said transfer film.

5. An image forming apparatus according to claim 1, wherein control means for preventing storage of charges occurring due to an influence of said transfer film is provided in a portion of said internally and upwardly pushing member adjacent to said transfer film or a portion of said internally and upwardly pushing member which is brought into contact with said transfer film.

6. An image forming apparatus comprising:

a transfer-medium holding member having a transfer film for adsorbing and carrying a transfer medium and arranged such that an image is formed on said transfer medium;

an internally and upwardly pushing member movably disposed on a surface of said transfer film opposite to a surface to which the transfer medium is adsorbed;

moving means for moving said internally and upwardly pushing member by a predetermined quantity so that said internally and upwardly pushing member upwardly pushes said transfer film to deform said transfer film to separate the transfer medium from said transfer film; and control means for preventing storage of charges occurring due to an influence of said transfer film, said control means being provided for a portion of said internally and upwardly pushing member adjacent to said transfer film or a portion of said internally and upwardly pushing member which is brought into contact with said transfer film.

7. A separating apparatus of a multiple transfer apparatus according to claim 6, wherein said internally and upwardly pushing member is made of a charging material of a type which is electrically charged to have a polarity opposite to the charge of said transfer film.

8. A separating apparatus of a multiple transfer apparatus according to claim 7, wherein said internally and upwardly pushing member is made of resin which is negatively charged.

9. A separating apparatus of a multiple transfer apparatus according to claim 8, wherein said internally and upwardly pushing member is made of fluororesin or resin containing a fluorine component.

10. A separating apparatus of a multiple transfer apparatus according to claim 9, wherein said internally and upwardly pushing member is a rotational roll.

11. A separating apparatus of a multiple transfer apparatus according to claim 10, further comprising a grounded conductive brush which is brought into contact with said roll.

* * * * *